US006299529B1

(12) United States Patent
Preston

(10) Patent No.: US 6,299,529 B1
(45) Date of Patent: Oct. 9, 2001

(54) DRYER VENT GUARD

(76) Inventor: Helen J. Preston, 1956 E. 93rd St., Chicago, IL (US) 60617

( * ) Notice: Subject to any disclaimer, the term of this patent is extended or adjusted under 35 U.S.C. 154(b) by 0 days.

(21) Appl. No.: 09/588,897

(22) Filed: Jun. 7, 2000

(51) Int. Cl.[7] ..... F24P 13/20
(52) U.S. Cl. ..... 454/367
(58) Field of Search ..... 454/367, 359, 454/353

(56) References Cited

U.S. PATENT DOCUMENTS

| | | | | |
|---|---|---|---|---|
| 1,509,848 | * | 9/1924 | Silver | 454/367 |
| 4,920,867 | * | 5/1990 | Joly | 454/367 |
| 4,967,490 | * | 11/1990 | Berger et al. | 454/367 |
| 5,547,422 | | 8/1996 | Seboldt . | |
| 5,616,076 | | 4/1997 | Higgins . | |
| 5,632,678 | * | 5/1997 | Doelfel | 454/366 |
| 5,722,181 | | 3/1998 | Meyer . | |
| 5,916,023 | | 6/1999 | Meyer . | |

* cited by examiner

*Primary Examiner*—Harold Joyce
*Assistant Examiner*—Derek S. Boles
(74) *Attorney, Agent, or Firm*—Henderson & Sturm LLP

(57) ABSTRACT

A dryer exhaust hood that prevents birds and other creatures from entering a dryer ventilating system. The guard includes an air-pervious panel sized to fit over the exhaust opening of the exhaust hood, a pair of spaced guard flanges that overlie the flanges on opposing sides of the exhaust hood, and a pair of resilient clips that frictionally engage and releasably secure the guard flanges to the hood flanges. The guard also includes alignment tabs that extend from the air-pervious panel to engage portions of the exhaust hood adjacent the exhaust opening.

5 Claims, 1 Drawing Sheet

Fig. 1
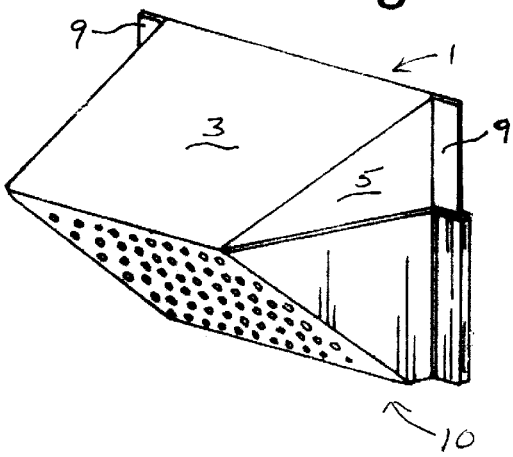
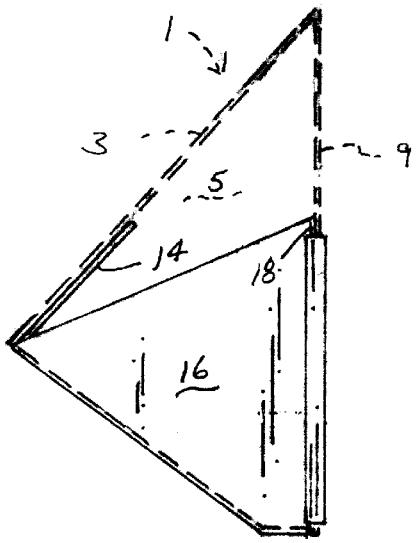
Fig. 3
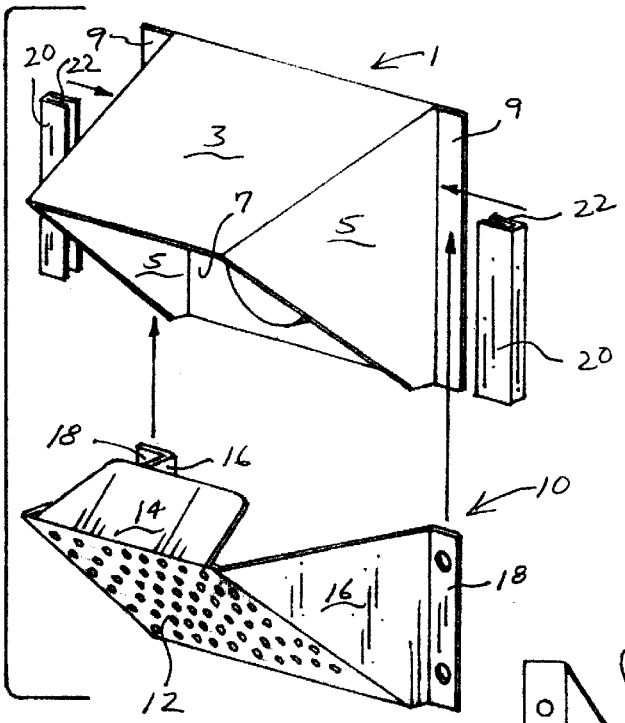
Fig. 2
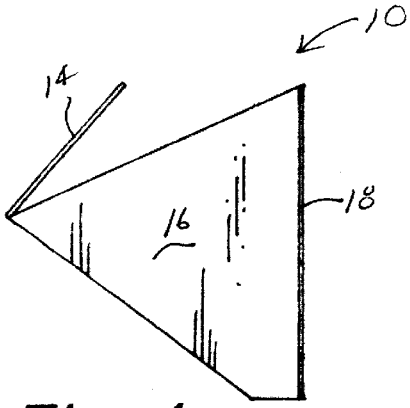
Fig. 4
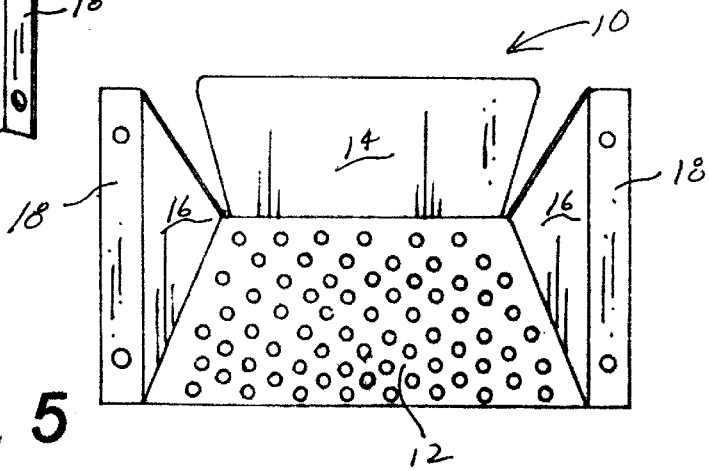
Fig. 5

DRYER VENT GUARD

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of exhaust hoods for dryers, and more particularly to an outside guard for the exhaust opening of the exhaust hood.

2. Description of Related Art

As can be seen by reference to the following U.S. Pat. Nos. 5,547,422; 5,616,076; 5,722,181 and 5,916,023 the prior art is replete with myriad and diverse guards for exhaust hoods.

While all of the aforementioned prior art constructions are more than adequate for the basic purpose and function for which they have been specifically designed, they are uniformly deficient with respect to their failure to provide a simple, efficient, and practical dryer vent guard. Often, birds and other creatures make their way inside the dryer ventilation systems of homes and cause numerous problems. The only way inside the ventilation system is through the exhaust opening of the dryer exhaust hood exposed to the outside.

As a consequence of the foregoing situation, there has existed a longstanding need for a new and improved dryer vent guard and the provision of such a construction is a stated objective of the present invention.

BRIEF SUMMARY OF THE INVENTION

Briefly stated, the present invention provides a dryer exhaust hood that prevents birds and other creatures from entering a dryer ventilating system. The guard includes an air-pervious panel sized to fit over the exhaust opening of the exhaust hood, a pair of spaced guard flanges that overlie the flanges on opposing sides of the exhaust hood, and a pair of resilient clips that frictionally engage and releasably secure the guard flanges to the hood flanges. The guard also includes alignment tabs that extend from the air-pervious panel to engage portions of the exhaust hood adjacent the exhaust opening.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein:

FIG. 1 is a perspective view of the dryer vent guard of the present invention secured in position on a conventional dryer exhaust hood;

FIG. 2 is an exploded perspective view illustrating the attachment of the guard to the exhaust hood by use of resilient clips;

FIG. 3 is a side elevational view of the guard with the dryer vent hood shown in dashed lines;

FIG. 4 is a side elevational view of the guard; and

FIG. 5 is a rear elevational view thereof.

DETAILED DESCRIPTION OF THE INVENTION

As can be seen by reference to the drawings, and in particularly to FIG. 1, the dryer vent guard that forms the basis of the present invention is designated generally by the reference number 10. The guard 10 is sized to fit over a dryer exhaust hood 1 that has top wall 3, side walls 5, a central exhaust opening 7, and a pair of hood flanges 9 disposed on opposite lateral sides of the exhaust opening 7. The guard 10 includes a perforated air-pervious panel 12, a top wall alignment tab 14, side wall alignment tabs 16, and a pair of guard flanges 18.

In use, the guard 10 slides up and around the existing dryer exhaust hood 1 as illustrated in FIG. 2. The top wall alignment tab 14 engages a portion of the inside of the hood top wall 3, the side wall adjustment tabs 16 engage portions of the outside of the hood side walls 5, and the guard flanges 18 overlie the hood flanges 9. A pair of resilient plastic clips 20 are then positioned so that the open channel 22 frictionally engages the hood flange 9 and overlying guard flange 18 to secure the guard 10 in position where the air-pervious panel 12 covers the exhaust opening 7. The guard 10 may be easily and conveniently removed by removing the clips 20 and pulling the guard 10 down.

The guard 10 may be made of any suitable material such as 24 gauge aluminum using a series of punching and bending operations. The clips 20 may be made from a stock extruded plastic cut to the desired length. Also, it is to be understood that the dryer vent guard 10 may be made, measured and adjusted to fit other vents manufactured in circles, squares, oblongs, V-shapes, etc., similar to the original style.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A guard for a dryer exhaust hood including a pair of spaced hood flanges disposed on opposing lateral sides of a downwardly directed exhaust opening, the guard comprising:

an air-pervious panel sized to cover the exhaust opening of the exhaust hood;

a pair of spaced guard flanges disposed on opposing lateral sides of the panel, the guard flanges being disposed to overlie the hood flanges; and a pair of clips disposed to engage and releasably secure the guard flanges to the hood flanges, whereby the air-pervious panel is secured in position over the exhaust opening wherein the clips include an elongated resilient body member including an open channel, the open channel being disposed to frictionally engage the good flange and overlying guard flange and secure them against movement with respect to each other.

2. The guard of claim 1, further including alignment tabs extending from the air-pervious panel and disposed to engage portions of the exhaust hood adjacent the exhaust opening.

3. The guard of claim 2 wherein the clips include an elongated resilient body member including an open channel, the open channel being disposed to frictionally engage the hood flange and overlying guard flange and secure them against movement with respect to each other.

4. A guard for a dryer exhaust hood including a pair of spaced hood flanges disposed on opposing lateral sides of a downwardly directed exhaust opening, the guard comprising:

a air-pervious panel sized to cover the exhaust opening of the exhaust hood;

a pair of spaced guard flanges disposed on opposing lateral sides of the panel, the guard flanges being disposed to overlie the hood flanges;

a pair of clips disposed to engage and releasably secure the guard flanges to the hood flanges, whereby the air-pervios panel is secured in position over the exhaust opening, wherein the clips include an elongated resilient body member including an open channel, the open channel being disposed to frictionally engage the hood flange and overlying guard flange and secire them against movement with respect to each other; and, alignment tabs extending from the air-pervious panel and disposed to engage portions of the exhaust hood adjacent to the exhaust opening.

5. The guard of claim 4 wherein the clips include an elongated resilient body member including an open channel, the open channel being disposed to frictionally engage the hood flange and overlying guard flange and secure them against movement with respect to each other.

* * * * *